US005343577A

United States Patent [19]

Petrovich

[11] Patent Number: 5,343,577

[45] Date of Patent: Sep. 6, 1994

[54] COMMODE FLOAT TOY TRAINING DEVICE

[76] Inventor: Melinda L. Petrovich, HCR 78 Box 350P, Naselle, Wash. 98638

[21] Appl. No.: 905,679

[22] Filed: Jun. 29, 1992

[51] Int. Cl.[5] ..... A47K 17/00; A63H 23/02

[52] U.S. Cl. ..... 4/661; 4/300.3; 446/160

[58] Field of Search ..... 434/247; 4/300.3, 301, 4/661; 446/153, 160

[56] References Cited

U.S. PATENT DOCUMENTS 4,010,497 3/1977 Menter et al. ..... 4/300.3

4,062,070 12/1977 Prince ..... 4/300.3

5,117,515 6/1992 White, Jr. et al. ..... 4/300.3 X

*Primary Examiner*—Mickey Yu

*Attorney, Agent, or Firm*—E. Michael Combs

[57] ABSTRACT

A float toy formed of water soluble material is arranged for flotation within a commode to provide for training of young children, and particularly boys, to properly train and provide for a focal point in the use of the commode. The float toy structure is arranged to include a plurality of rows of water soluble rods of various colorations to maintain interest and focus of children in use of the device.

1 Claim, 4 Drawing Sheets

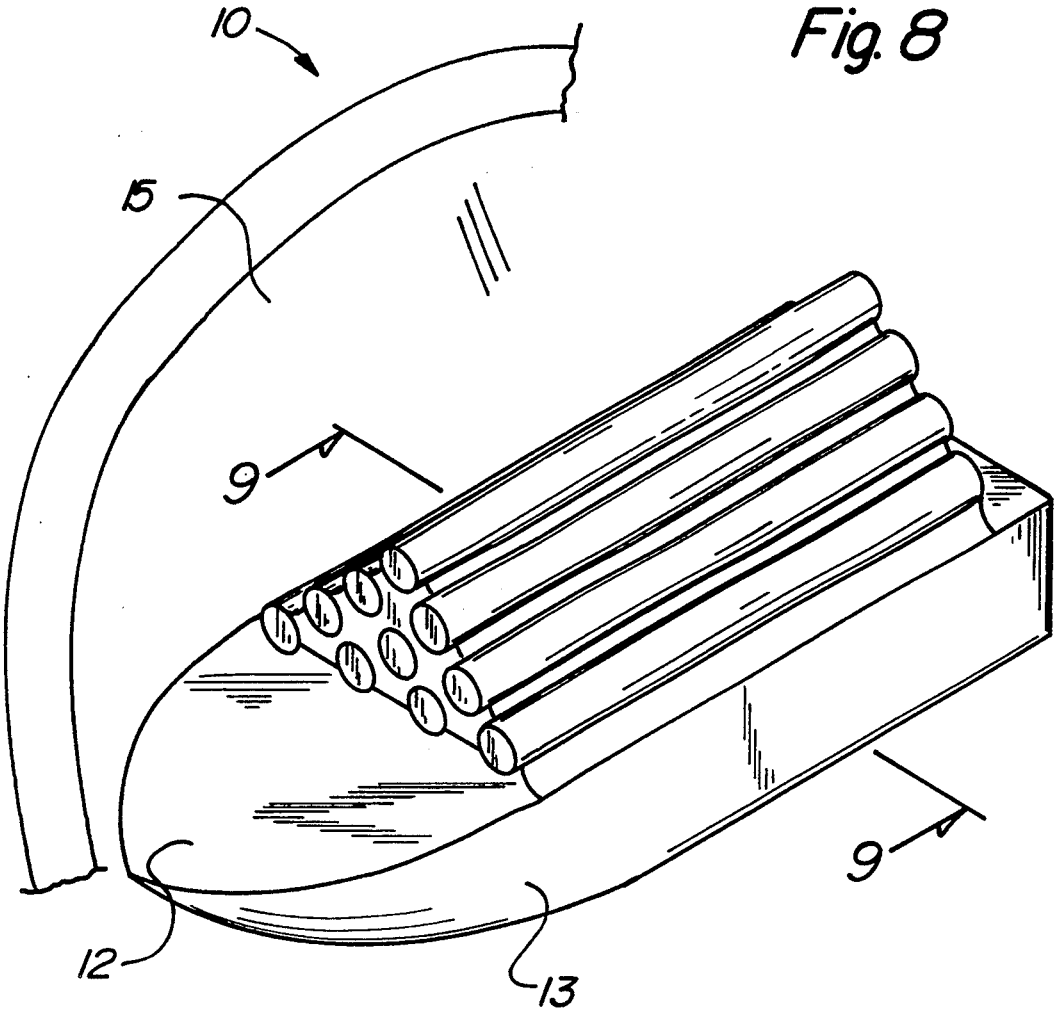
Fig. 8
Fig. 9
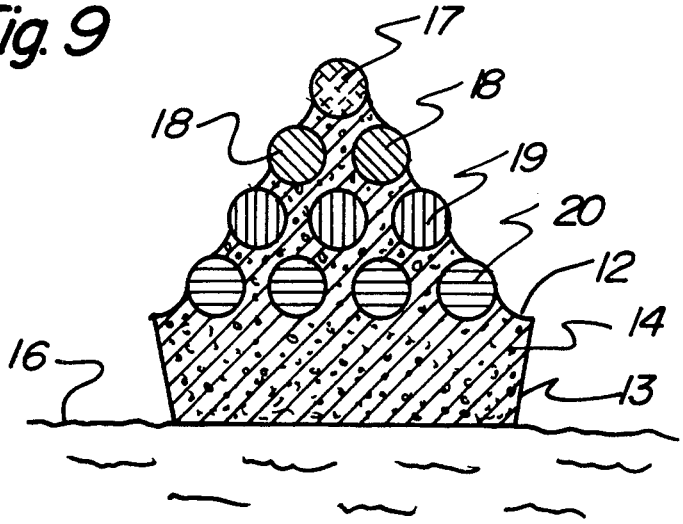

COMMODE FLOAT TOY TRAINING DEVICE

BACKGROUND OF THE INVENTION

1. Field of the Invention

The field of invention relates to flat toy structure, and more particularly pertains to a new and improved commode float toy training device for use by young boys in proper utilization of a commode.

2. Description of the Prior Art

Young boys, due to lack of experience, as well as limited attention span, frequently misuse a commode during urination requiring frequent clean-up and sanitizing of the commode structure. The instant invention attempts to overcome deficiencies of the prior art by providing for a water soluble float toy having dye rods of various colorations to maintain focus and attention of a youth in utilization with the organization, wherein during urination, the successive rows of coloration dyes are sequentially dissolved maintaining interest and focus of a child's attention in proper use of a commode. During such training, a child is taught the proper use of a commode during urination, and particularly such children such as boys to train such boys in proper hygiene in use of commode structure.

Prior art float toys of various configurations are utilized throughout the prior art such as exemplified in U.S. Pat. Nos. 4,313,277; 4,342,174; 4,515,572; 4.045,907; and 4,846,751.

The prior art float toys have typically been for amusement while children are bathing, wherein the instant invention is arranged for a biodegradable water soluble toy structure of one-time use to provide for training in young boys in proper use of a commode and in this respect, the present invention substantially fulfills this need.

SUMMARY OF THE INVENTION

In view of the foregoing disadvantages inherent in the known types of flat toy structure now present in the prior art, the present invention provides a commode flat toy training device wherein the same is arranged to focus a young boy's attention in use of a commode during urination. As such, the general purpose of the present invention, which will be described subsequently in greater detail, is to provide a new and improved commode float toy training device which has all the advantages of the prior art float toy apparatus and none of the disadvantages.

To attain this, the present invention provides a float toy formed of water soluble material arranged for flotation within a commode to provide for training of young children, and particularly boys, to properly train and provide for a focal point in the use of the commode. The flat toy structure is arranged to include a plurality of rows of water soluble rods of various colorations to maintain interest and focus of children in use of the device.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved commode float toy training device which has all the advantages of the prior art float apparatus and none of the disadvantages.

It is another object of the present invention to provide a new and improved commode float toy training device which may be easily and efficiently manufactured and marketed.

It is a further object of the present invention to provide a new and improved commode float toy training device which is of a durable and reliable construction.

An even further object of the present invention is to provide a new and improved commode float toy training device which is susceptible of a low cost of manufacture with regard to both materials and labor, and which accordingly is then susceptible of low prices of sale to the consuming public, thereby making such commode float toy training devices economically available to the buying public.

Still yet another object of the present invention is to provide a new and improved commode float toy training device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an isometric illustration of a float toy structure of the invention utilizing a plurality of multi-colored dye rods in successive rows.

FIG. 9 is an orthographic view, taken along the lines 9—9 of FIG. 8 in the direction indicated by the arrows.

DESCRIPTION OF THE PREFERRED EMBODIMENT

Figure 1:
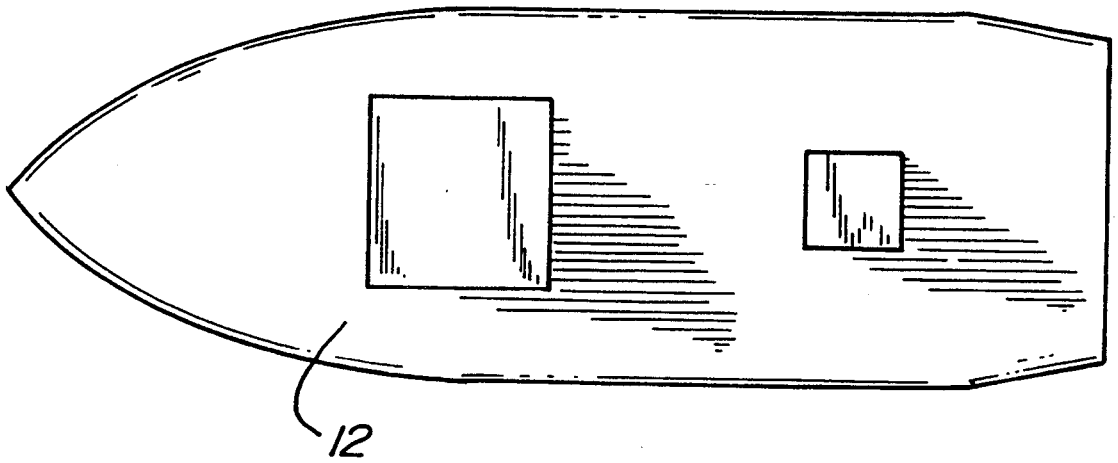
FIG. 1 is an orthographic top view of a configuration of the float toy structure.
Figure 2:
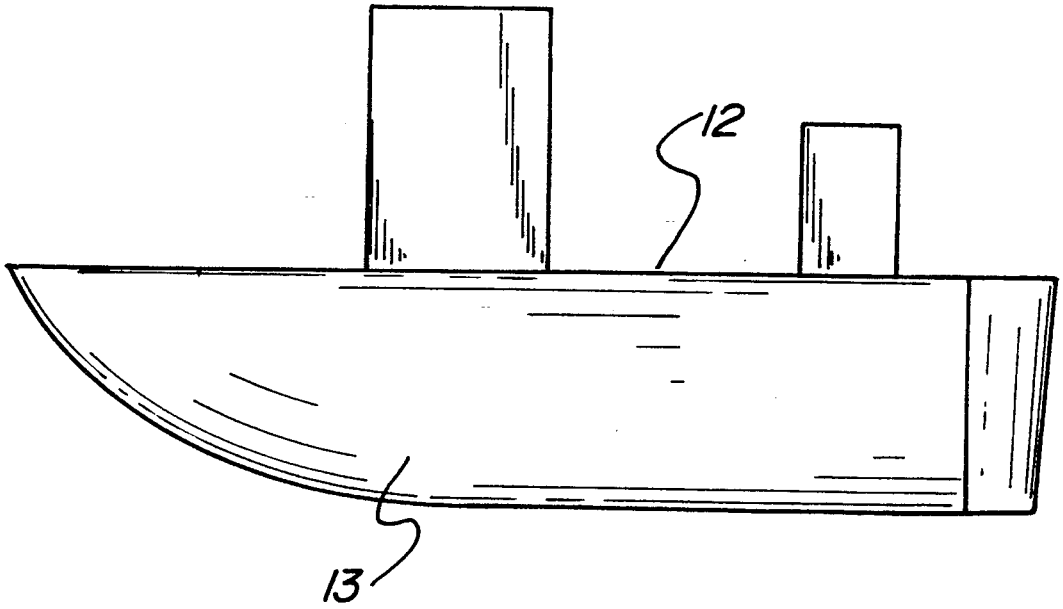
FIG. 2 is an orthographic side view of the float toy structure.
Figure 3:
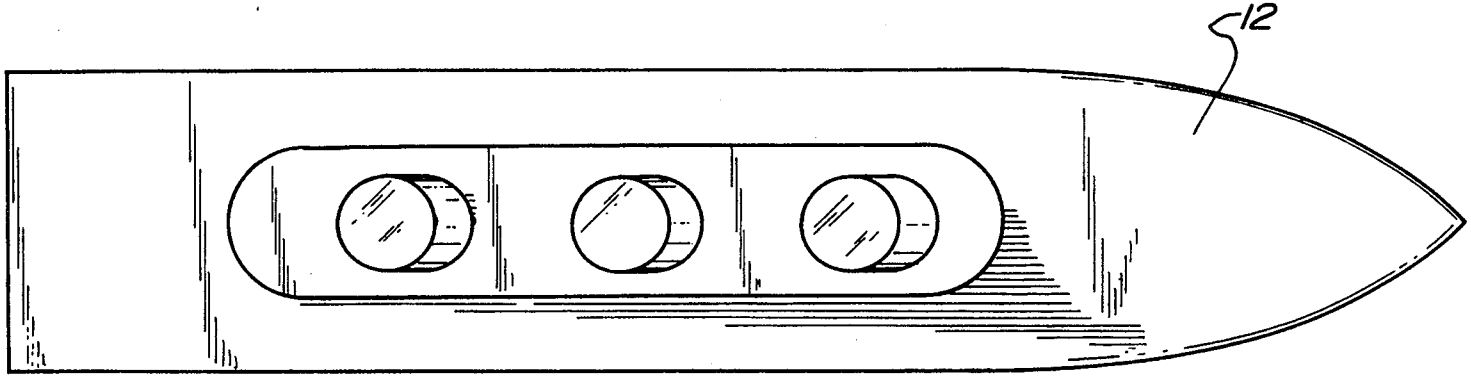
FIG. 3 is an orthographic top view of a further configuration of the float toy structure.
Figure 4:
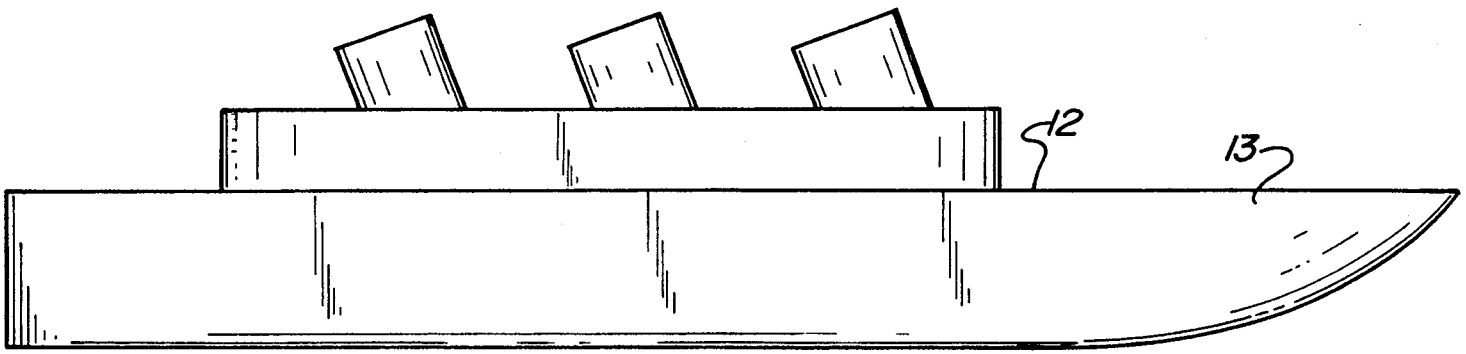
FIG. 4 is an orthographic side view of the further configuration, as set forth in FIG. 3.
Figure 5:
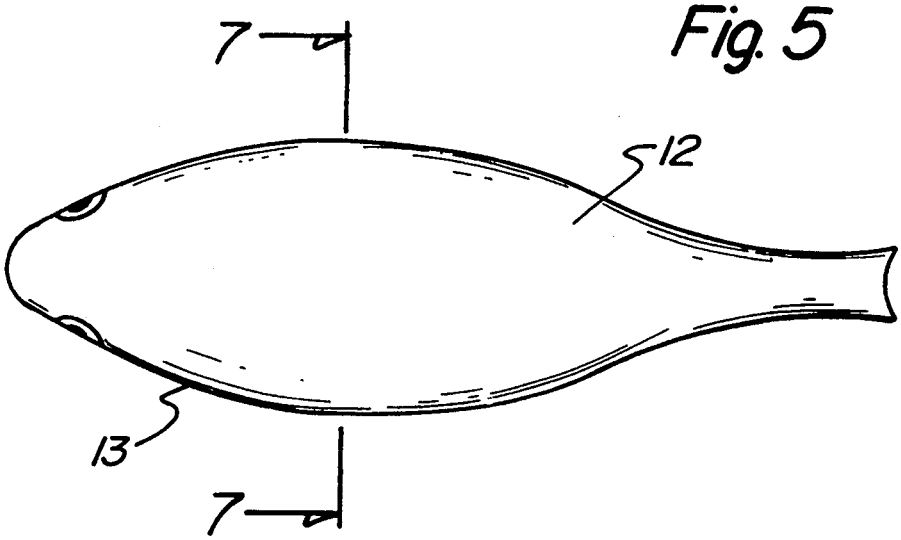
FIG. 5 is an orthographic side view of a yet further configuration of the float toy structure.
Figure 6:
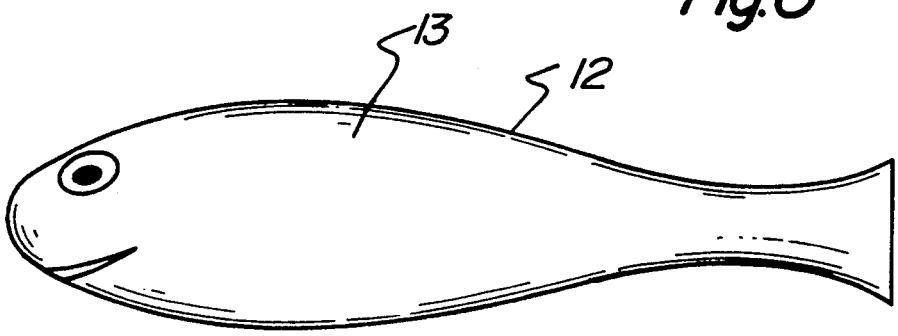
FIG. 6 is an orthographic side view of the yet further configuration of the float toy structure.
Figure 7:
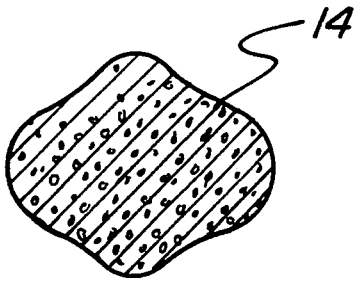
FIG. 7 is an orthographic view, taken along the lines 7—7 of FIG. 5 in the direction indicated by the arrows.

With reference now to the drawings, and in particular to FIGS. 1 to 9 thereof, a new and improved commode float toy training device embodying the principles and concepts of the present invention and generally designated by the reference numeral 10 will be described.

More specifically, the commode float toy training device 10 of the instant invention is formed as a unitary toy member exhibiting buoyancy within water to permit the toy to float along a top surface of the water, as illustrated in FIG. 9 for example, along a water level top surface 16. The float toy is typically formed with a top wall 12 and a curvilinear side wall 13 to permit rocking of the float toy upon impinging of the float toy during urination by a boy to maintain interest and focus of the boy during training in a proper use of a commode 15, as illustrated in the FIG. 8. The toy member is formed as a water soluble body 14 of a predetermined coloration. In the construction of the organization, as set forth in FIGS. 8 and 9, a first dye rod 17 of a first coloration is arranged parallel to and above a second row of second dye rods 18 of a second coloration, that in turn are positioned above and parallel a third row of third dye rods 19 of a third coloration, and if required, a fourth row of fourth dye rods 20 of a fourth coloration. The successive dye rods provide for the ever changing of coloration upon impacting of the dye rods upon urination by a boy thereby maintaining interest and focus of the child in the training of the child to strike within the commode 15, and particularly onto the water surface 15 within the commode.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A commode float toy training device, comprising, a toy member formed of a water soluble, buoyant material of a predetermined coloration; and the toy member including a top wall of a generally planar configuration, and a curvilinear side wall to permit rocking of the toy member when positioned upon a water surface, and a first dye rod of a first coloration mounted to a portion of the toy member spaced above and parallel to the top wall, a second row of second dye rods of a second coloration mounted to a portion of the toy member and positioned parallel to and between the first dye rod and the top wall, and a third row of third dye rods of a third coloration mounted to a portion of the toy member and oriented between the second dye rods and the top wall, wherein the dye rods provide for a changing of coloration of water within a commode upon impacting of the dye rods with urine during urination within the commode by a user, thereby maintaining interest and focus of the user during urination.

* * * * *